US005773080A

United States Patent [19]

Simmons et al.

[11] Patent Number: 5,773,080

[45] Date of Patent: Jun. 30, 1998

[54] PATTERN COATING OF THICK FILM PRESSURE SENSITIVE ADHESIVES

[76] Inventors: George Simmons, 9440 Headlands Rd., Mentor, Ohio 44060; John L. Schmitz, 19080 Tilden Rd., Hiram, Ohio 44234

[21] Appl. No.: 843,865

[22] Filed: Apr. 17, 1997

[51] Int. Cl.[6] ..... B05D 5/10

[52] U.S. Cl. ..... 427/208.6; 427/177; 427/286; 427/385.5; 427/420; 427/552; 427/558

[58] Field of Search ..... 427/286, 208.6, 427/385.5, 552, 558, 420, 177

[56] References Cited

U.S. PATENT DOCUMENTS

| | | | |
|---|---|---|---|
| 4,145,465 | 3/1979 | Sanderson et al. | 428/31 |
| 4,223,067 | 9/1980 | Levens | 428/308 |
| 4,252,596 | 2/1981 | Fuglein | 156/450 |
| 4,343,856 | 8/1982 | Gaswami et al. | 428/332 |
| 4,379,201 | 4/1983 | Heilmann et al. | 428/345 |
| 4,833,193 | 5/1989 | Sieverding | 524/486 |
| 4,855,170 | 8/1989 | Darvell et al. | 428/40 |
| 4,888,075 | 12/1989 | Freedman | 156/243 |
| 4,906,421 | 3/1990 | Plamthottam et al. | 264/22 |
| 4,931,347 | 6/1990 | Slovinsky et al. | 428/192 |
| 4,946,532 | 8/1990 | Freeman | 156/243 |
| 5,100,728 | 3/1992 | Plamthottam et al. | 428/345 |
| 5,180,635 | 1/1993 | Plamthottam et al. | 428/345 |
| 5,183,833 | 2/1993 | Fisher et al. | 522/182 |
| 5,186,782 | 2/1993 | Freedman | 156/244.11 |
| 5,372,669 | 12/1994 | Freedman | 156/243 |
| 5,421,921 | 6/1995 | Gill et al. | 156/62.4 |
| 5,421,941 | 6/1995 | Allen et al. | 427/208.6 |
| 5,458,291 | 10/1995 | Brusko et al. | 239/423 |
| 5,516,393 | 5/1996 | Freedman | 156/229 |
| 5,667,850 | 9/1997 | Gaven et al. | 427/207.1 |

FOREIGN PATENT DOCUMENTS

| | | |
|---|---|---|
| 431336 B1 | 8/1990 | European Pat. Off. . |
| WO 93/07228 | 4/1993 | WIPO . |
| WO 94/18280 | 8/1994 | WIPO . |

*Primary Examiner*—Janyce Bell
*Attorney, Agent, or Firm*—Oldham & Oldham Co., LPA

[57] ABSTRACT

The invention encompasses the pattern coating of a thick layer of adhesive on a single substrate. The adhesive strips may be continuous or discontinuous on the single substrate. In one preferred embodiment of the invention, the substrate is a release liner and the adhesive is a hot melt, thereby not requiring the use of an extruder in the application of the adhesive onto the substrate. When it is desired to produce a non-foamed product, the web is chilled on a chilled drum. Elimination of this chilling step, results in the formation of a foamed tape product, due to the evaporation of the moisture which is typically contained within the silicone-coated paper web. The product is a thick (10–100 mils), free (no carrier) film of adhesive made to the desired width (⅜" to approximately 6") of a high cohesive strength adhesive, with good temperature resistance (>196° F.), with low bubble content (appears clear), wound into rolls containing from 100–800 feet or greater in length.

43 Claims, 4 Drawing Sheets

PATTERN COATING OF THICK FILM PRESSURE SENSITIVE ADHESIVES

TECHNICAL FIELD

This invention relates to pattern coating of thick pressure sensitive adhesives by melt processing onto a substrate.

BACKGROUND OF THE INVENTION

In many industries, a transition is being observed from solvent adhesives and mechanical fasteners to water based adhesives. While these adhesives offer many environmental advantages, they dry much more slowly and thus slow down the output and potentially cause more rework. This has caused a review of other pressure sensitive product offerings, e.g., free adhesive films, double coated foams and films. These however, were generally too thin (1–4 mils) or too costly to meet the needs of the industry.

In the past for example, recreational vehicles had been assembled using solvent adhesives applied by brush or roller and air-dried. However, with more recent Environmental Protection Agency concerns regarding solvent emissions, the industry has turned to water-based adhesives and pressure sensitive tapes. These were used with mechanical fasteners to assemble the walls, roof, interior moldings, tub surrounds, mirrors, HVAC ducts, etc. Since the water-based adhesives were slow drying, more mechanical fasteners were needed to hold the construction together until the adhesive set. Additionally, the pressure sensitive tapes had thin adhesive layers (e.g., 4 mils), that would not bridge the gap on rough materials. Adhesive coated foams, while thicker, also failed in the foam when a load was applied while mechanical fasteners caused leaks in the vehicles.

In the construction industry, e.g., housing, prefabricated houses, mobile homes, truck cabs, school buses, ambulances, and part suppliers, e.g., finish moldings, paneling, tub and shower surrounds, mirror mounting, soap and towel dispensers and HVAC ductwork, the need also exists for a thick adhesive which is cost-effective and readily available.

Although thick (15–35 mil) adhesives have been reported in the literature, these adhesives are UV/EB cured systems that are very high cost and not suited to construction applications. No product is currently available to fill this need at a competitive price.

Initial attempts to make thick pressure sensitive adhesives failed due to the inability to coat the thick (greater than 10 mils) adhesive product. It is not generally possible to slit through a high mass of sticky adhesive to make narrow strips in a cost-effective manner. Additionally, traditional solvent or water casting techniques are too slow to be economically practical, and the resulting adhesive films are of poor quality, e.g., bubbles, thickness variations, and retained solvent.

It has been generally recognized that the manufacture of single strips (⅜" to 6"wide) is non-economical. Wide (60") coaters cannot coat thick hot melt adhesive and the output of the large coaters is excessive for a new start up business. This led to experimentation with narrow (8") dies that would produce multiple narrow strips. However, die manufacturers indicated that thick films of adhesives had not been made. Through experiments with the use of die shims in the wider dies, it is now possible to make narrow (⅜" to 6"wide) strips by shim changes.

The thick adhesives of this invention fill gaps between rough and uneven surfaces and can provide an immediate high bond strength (10–20 psi). For ease of application, they can be made in various widths (⅜" to 6"wide) and lengths of from 100 to 5,000 feet. Some applications use 2 or 3 strips of adhesive on one substrate. Some applications require the use of intermittent strips of adhesive (e.g., 3" of adhesive and ½" gap between adhesive strips, to make it easier to cut off uniform length sections. Normal preferred thicknesses are between 20 and 35 mils, although a range of thicknesses are available from 10 to 300 mils. The adhesive is of high density (bubble-free) thereby achieving good adhesion as needed by the application, although in one embodiment of this invention, the adhesive can be foamed.

The invention provides a high performance mounting and bonding product that additionally fills the gap filling properties which had typically required the use of thick elastomeric foam carriers and solvent acrylic adhesive systems which were prone to end use failure due to the inherent weakness of the elastomeric foam carrier. High mass pressure sensitive adhesive coatings are stronger than elastomeric foam carriers, but traditional process technologies limited the practical coating thickness to 10 mils or less. This invention overcomes previous process limitations and provides for the economic production of high mass/high bond strength pressure sensitive adhesives.

SUMMARY OF THE INVENTION

The invention encompasses the pattern coating of a thick layer of adhesive on a single substrate. The adhesive strips may be continuous or discontinuous on the single substrate. In one preferred embodiment of the invention, the substrate is a release liner and the adhesive is a hot melt, thereby not requiring the use of an extruder in the application of the adhesive onto the substrate. When it is desired to produce a non-foamed product, the web is chilled on a chilled drum.

Elimination of this chilling step, results in the formation of a foamed tape product, due to the evaporation of the moisture which is typically contained within the silicone-coated paper web.

The product is a thick (10–100 mils), free (no carrier) film of adhesive made to the desired width (⅜" to approximately 6") of a high cohesive strength adhesive, with good temperature resistance (>196° F.), with low bubble content (appears clear), wound into rolls containing from 100 –800 feet or greater in length. Multiple rolls can be wound onto spools holding 5,000 feet or more in length.

These and other objects of this invention will be evident when viewed in light of the drawings, detailed description, and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DESCRIPTION OF THE PREFERRED EMBODIMENTS

Figure 1:
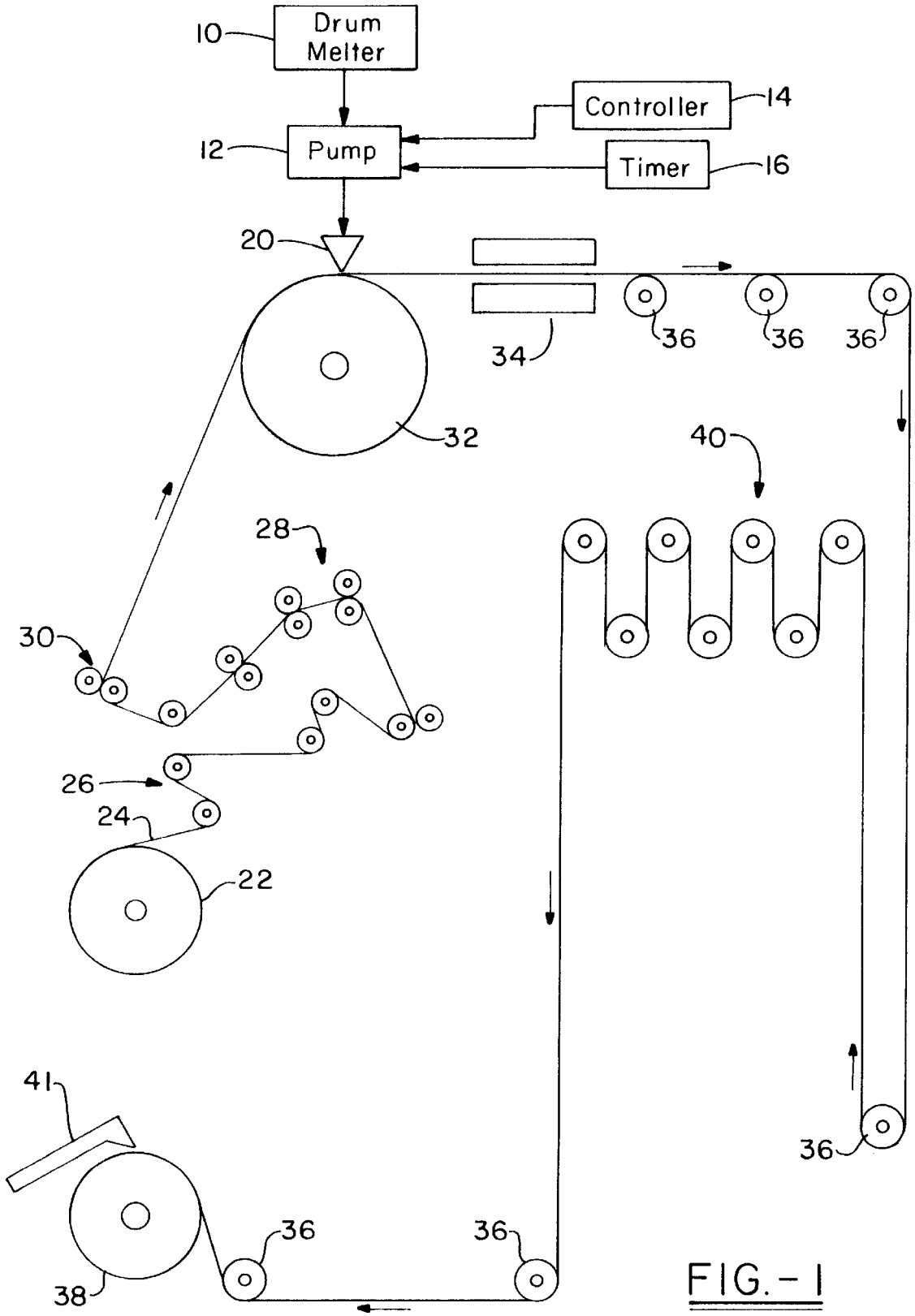
FIG. 1 schematically illustrates a process as may be applied to generating an adhesive pattern-coated substrate according to the present invention.

This invention will now be described in detail with referenced to preferred embodiments thereof. Throughout the specification, including the claims, compositions are given in percent by weight unless the contrary is expressly stated.

In general, the overall process entails the use of a drum melter which melts the adhesive to a temperature at which it is pumpable into a reservoir which pumps the adhesive to a die equipped with a die shim. The adhesive is applied to a release liner web which is carried over a drum, typically aluminum and optionally cooled, when adhesive foaming is not desired.

The adhesive material is a pressure sensitive adhesive and preferably a hot-melt adhesive. The pressure sensitive adhesive is normally tacky at room temperatures, and is pumpable when heated. In addition, the adhesive should have a viscosity form about 10,000 to about 60,000 centipoise at 350° F. temperature. Pressure sensitive adhesives useful in this embodiment include hot-melt adhesives and other pressure sensitive adhesives which are known in the art. Examples of commercial hot melt adhesives would include those sold by National Starch and Adhesives, H.B. Fuller or Findley Adhesives, e.g., 2038. The equipment used to coat these hot melt adhesives is commercial equipment from Valco or Nordson.

Hot-melt adhesive include A-B-A block copolymers such as those disclosed in U.S. Pat. No. 5,342,858. The A block is typically an alkenyl arene polymer derived from a monomer such as styrene. The B block is typically a polymer of a conjugated aliphatic diene monomer of 4 to 6 carbon atoms or a linear alkene monomer of 2 to 6 carbon atoms. Suitable dienes include butadiene, isoprene and the like. Suitable alkenes include ethylene, propylene, butylene and the like. When the A block is styrene-based and the B block is butadiene-based or isoprene-based, the blocks copolymers are referred to as S-B-S copolymers and S-I-S copolymers, respectively.

More broadly, the adhesive may be chosen from the following categories; urethanes, rubbers, acrylics, silicones, polyesters, and vinyls. Suitable pressure sensitive adhesives from each of these categories are known in the art. Acrylics include, for example, acrylate and methacrylate copolymers such as copolymers of methyl methacrylate and ethyl acrylate. Rubbers include, for example, terpolymer elastomers made from ethylene-propylene-diene monomer (EPDM) as well as styrene-butadiene rubbers (SBR), and polymers (including copolymers) of 1,4-butadiene and isoprene.

The pressure sensitive adhesive material is ordinarily a 100 percent solids composition, i.e., it contains no materials which are liquid at ordinary temperatures. Particulate solid materials, such as fillers, reinforcing agents, antioxidants, colorants, and other solid materials known in the art may be incorporated into the pressure adhesive material. Solid material loadings ordinarily are in the amount well known to those skilled in the art.

When a curable pressure sensitive adhesive has been used the layer will be cured by passing the entire laminate continuously through a curing station. Conventional curing methods, such as ultraviolet (LV), electron beam (EB) and heat curing may be used. Finally, the composite structure comprising an adhesive laminate and the release liner applied thereto are wound on a take-up roll.

The release liner web may be a conventional silicone coated paper having a moisture content from about 2 to about 6 percent by weight and coated on one or both sides with a silicone release coating. The release paper may be a conventional release paper, e.g., a 40 pound, 50 pound, 60 pound or 80 pound release paper. (40 pounds denotes a weight of 0.066 $kg/m^{2;}$ 80 pound corresponds to a weight of 0.132 $kg/m^2$). It should be noted that although a paper-based release liner is generally preferred, for some aspects of this invention, it is possible to have a non-paper based release liner, e.g., polymer film.

The layer (0.010" to 0.100") of pressure sensitive adhesive in molten form is laid down on the silicone coated side of the release liner. A conventional hot melt pump is used. The thickness of the pressure sensitive layer as formed on the release liner may vary from about 10 mils (0.010 inch or 0.25 mm) to about 100 mils (0.1 inch or 2.5 mm), preferably from about 15 mils (0.015 inch) to about 35 mils (0.035 inch).

Referring now to FIG. 1, a continuous web or strip of a silicone release liner 24, preferably a release paper, is unwound from unwind roll 22. The web or strip may be of any desired width. The release liner may be coated on one or both sides with a silicone release coating; at least the top side is coated. The release liner passes through a dancer roll / brake assembly 26 for tension control as well as a plurality of guide rolls 28 and nip rolls 30 for positioning on chill roll or casting drum 32. A continuous or intermittent stream of molten adhesive material is pumped by a high throughput gear pump 12 equipped with on/off controller 14 and timer 16 from drum melter 10 and laid down on a silicone coated surface of the release liner 24 through die 20 in a multi-strip fashion and passed through dryers and/or curing station 34 to remove residual moisture and/or solvent which may be present in the adhesive and/or cure the adhesive. The pattern coated adhesive passes on support rolls 36 onto TESA rolls 40 which function as an accumulator for eventual rewind on take up roil 38, optionally with the application of a slitter 41 to cut the web strips of adhesive.

Figure 2:
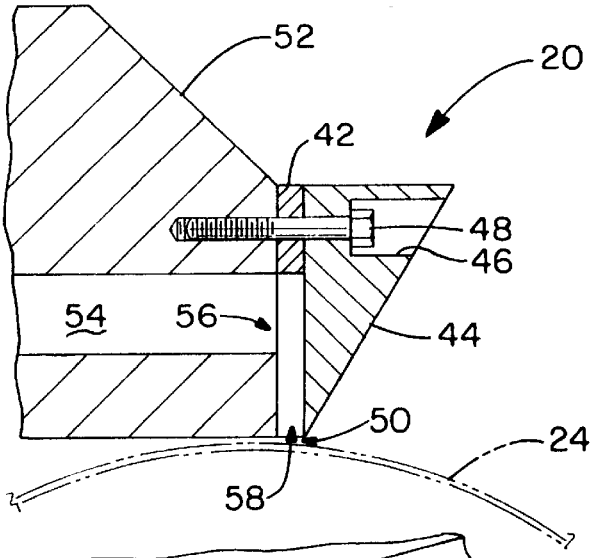
FIG. 2 is a side elevational view, in cross-section, showing the elements which form an exit die assembly for the application of an adhesive strip pattern to a substrate material, the substrate being shown in ghost lines.

In FIG. 2, a side elevational view, in cross-section the elements which form an exit die assembly for the application of adhesive in a pattern onto a substrate material is shown, the substrate being shown in ghost lines. The die 20 is comprised of a main body 52 with a plurality of passageways 54 therethrough. Attached to a front face of the die main body is a die shim 42 and an essentially triangular die shim attachment means 44 which additionally functions to level the applied adhesive, said shim attachment means securely affixed to the main body 52 by a plurality of fastening means 48, e.g., threadably engageable screws, or other similar devices, set into the die shim attachment means by recesses 46. In operation, the adhesive will pass from drum melter 10 through pumping station 12 into one of a plurality of adhesive passageways 54 to die exit bores 56 and into shim chambers 58 for application onto a silicone-coated surface of the release liner 24.

Figure 3:
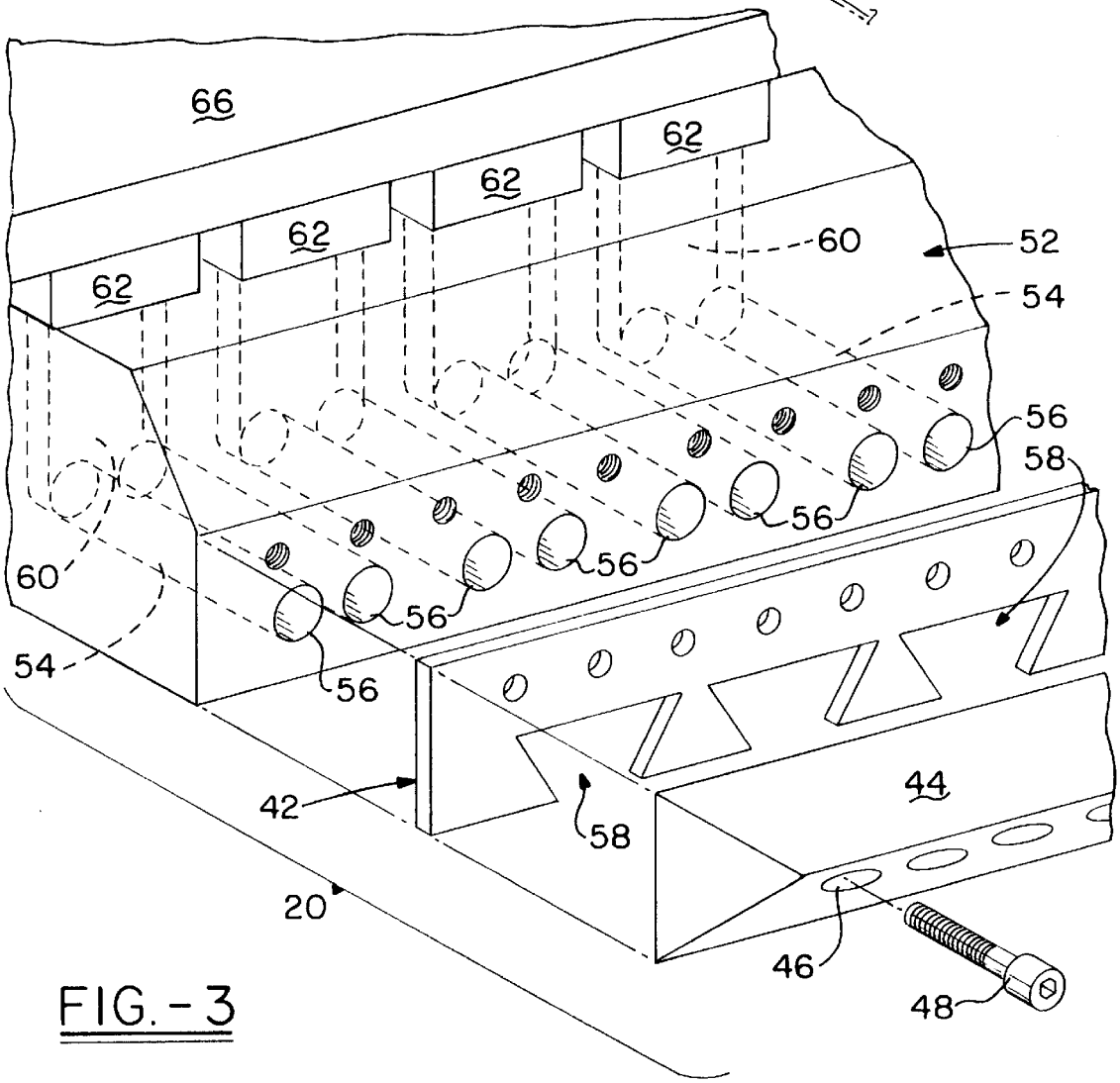
FIG. 3 is a perspective view illustrating the positions of the various elements forming the exit die assembly.

Illustrated in perspective in FIG. 3, die 20 is comprised of a main body 52 with a plurality of passageways 54 therethrough. Attached to the front face of the die main body is die shim 42 and triangular die shim attachment means 44 which is securely fastened to the die main body by a plurality of fastening means such as the threaded machine screw 48 which secures the die shim 42 interposed between die main body and die shim attachment means by a mating threaded passageway in the die main body 52. Within the die main body, an inlet passage diverges into a plurality of secondary feeds 66, through control valves 62 for recombination into a manifold of exit streams 60 which source exit passageways 54 through die exit bores 56. As shown in this figure, die shim 42 has a plurality of die shim chambers 58, which are shown to be essentially trapezoidal in shape and serve to channel the adhesive which exits from die exit bore 56 in a downward fashion through die shim chambers onto the release web 24.

Figure 4:
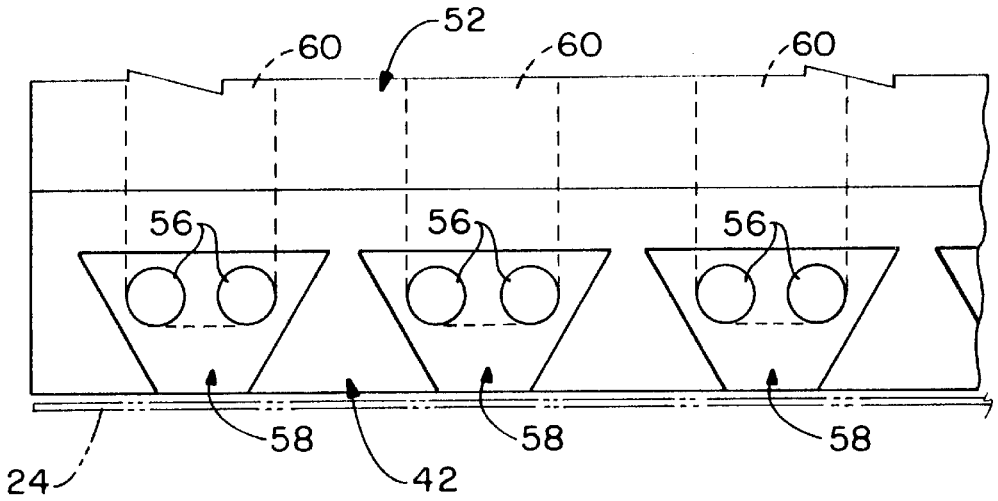
FIG. 4 is a frontal view of a die shim and supply manifold with die shim attachment means removed illustrating an adhesive strip pattern with the substrate shown in ghost lines.

In FIG. 4, a frontal view of a die shim and supply manifold with triangular die shim attachment means removed, is shown with two die exit bores 56 shown feeding each die shim chamber 58. By employing this geometric configuration for the die shim opening, a slight positive pressure is achieved in the die shim chambers 58, thereby resulting in a more uniform adhesive application onto the web substrate. While each die shim chamber 58 is shown to be fed by two die exit bores 56 in this view, there is no need to limit the application to such, and embodiments wherein greater and smaller numbers of exit bores feed one or multiple chambers are equally envisioned. It is also believed to be a part of this invention, where partial exit bores feed die shim chambers, such as might occur when a die shim employing a different number of die shim chambers were used, or when the geometric shape of the die shim chamber was modified. While configuration of the die shim chamber cross-sectional configuration is one way to achieve a pressurized exit stream, there are equivalent alternatives as shown for example in FIGS. 7 and 7A. In this arrangement, the cooperation between the front face of the die main body with the die shim 42' creates a die shim chamber 58 having a recess which is deeper at an upper portion of the front face and a narrower recess at a lower portion of the front face, i.e., at the chamber exit port 50, due to the relationship of the modified die shim shown in FIG. 7A. By varying the die shim 42' thickness, it is possible to achieve a similar result to that obtained when using the die shim 42 shown in FIG. 3 for example.

Figure 8:
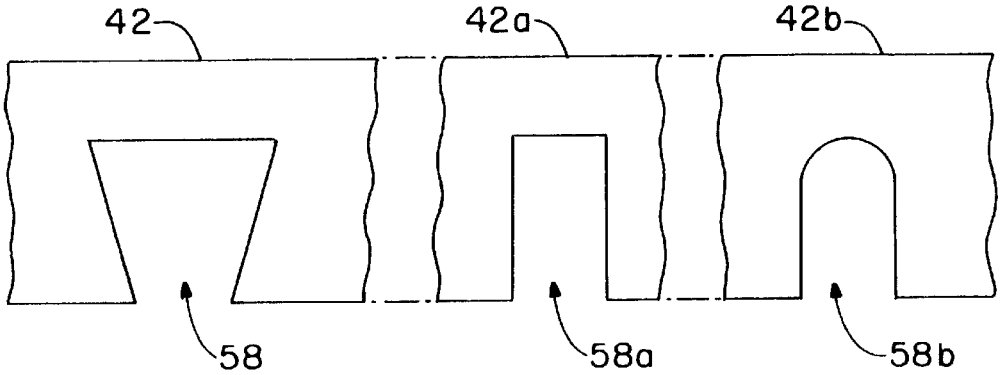
FIG. 8 illustrates various geometric die shim openings which may be applied to the invention.

In FIG. 8, various geometries are shown for the shape of the die shim chamber 58 within the die shim 42. While trapezoidal is a desirable shape, there may be instances wherein a more rectangular die shim chamber 58*a* is preferred for the die shim 42*a*, or even wherein an oblong slot die shim chamber 58*b* is preferred for the die shim 42*b*.

Figure 9:
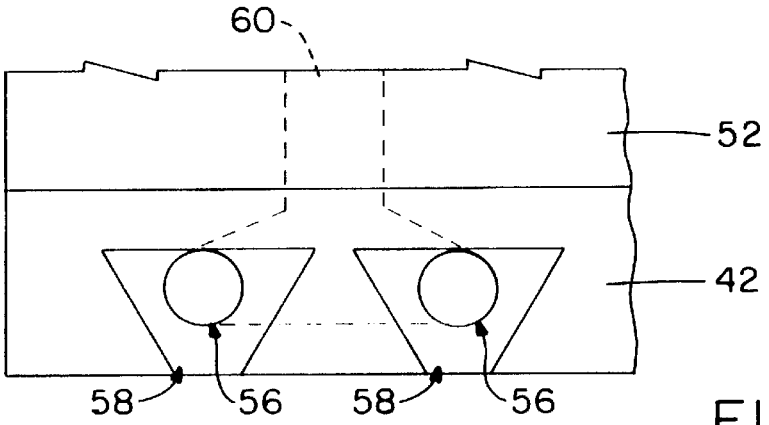
FIG. 9 is a front view similar to FIG. 4 showing an alternative manifold feed configuration which feeds two die shim openings.

While the invention has been described with essentially at least one die exit bore 56 feeding one die shim chamber 58, each exit bore being fed by one exit passageway 54, there is no need to limit the invention to such as illustrated in FIG. 9, wherein it is shown that one exit passageway 54 is capable of feeding at least two exit bores, each feeding a separate die shim chamber.

Figure 7:
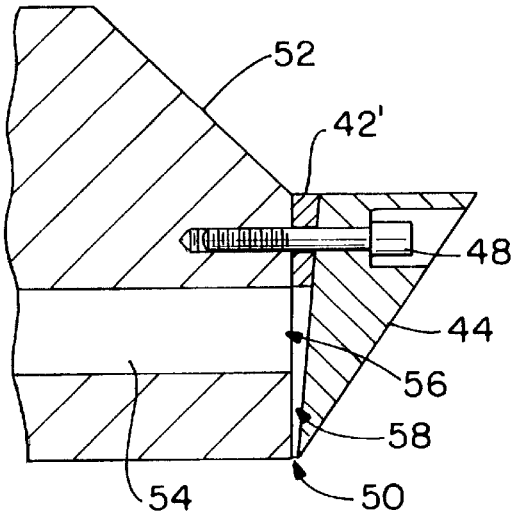
FIG. 7 is a sectional view similar to FIG. 2 showing an alternative configuration for an exit die shim.
Figure 7A:
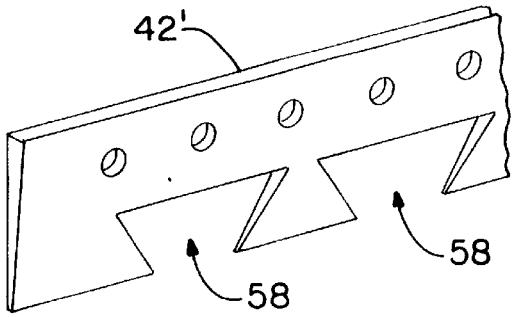
FIG. 7A is a perspective view of the die shim shown in FIG. 7.

Regardless of whether the thickness of the die shim is being used to create an increased pressure within the die chamber as discussed in association with FIGS. 7 and 7A, the thickness of the die shim can be variable, and is also dependent upon the thickness of the adhesive layer desired in combination with the flow rate of the adhesive through the die and to the velocity of the web. The die shims are typically 6–8 mils thick, although based on controlling the variables mentioned, it is possible to envision the use of both thicker and thinner shims, (e.g., 2 mils to 20 mils). There however is no direct relationship between the thickness of the die shim and the thickness of the applied adhesive to the web. As a general rule, thicker die shims are needed for 20 and 35 mil thick adhesive films.

In operation, the timer 16 preheats the unit to a setback temperature prior to the shift start. The operator places the correct die shim 42 onto the die main body 52 and secures the shim to the body by tightening fastening means 48 through the shim attachment means 44, enabling the operator to make the desired product after setting the temperature to the operating range. A web of differential release liner 24 is placed on the unwind roll 22 and the speed is set to the operational speed (e.g., 10 to 50 feet per minute, although higher and lower values are envisioned depending upon the capacity of the adhesive pump), and adhesive pump 12 turned on. The web is coated on an aluminum drum 32 and then air cooled to prevent foaming. The drum may be cooled to a temperature of approximately between 80° to 100° F. to aid this process. The combination of the pump, die and adhesive temperature are adjusted to make the desired product. The sample is checked for bubbles, thickness, strip width, uniformity of the profile and gap between strips. The web may be slit at slitting station 42 before being rewound with the adhesive side in. The web in unwound at essentially a constant speed into the web accumulator 40 and is rewound onto a rewind roll 38 in a start/stop manner from the accumulator.

When running intermittent pattern adhesive strips, the on/off controller 14 is activated and a five segment photosensor activated to get the desired pattern of adhesive and gap length. Proper profile must be obtained to prevent roll telescoping at the rewind. This is done through the die mount adjustments in conjunction with the temperature and pump speed adjustments.

Optionally, it is possible to provide the process described and discussed in association with FIG. 1 with a feedback loop mechanism which controls the volume of pumpable adhesive through any one particular die opening to minimize the flow variations between die openings, thereby insuring that the quantity of adhesive in any one adhesive strip is essentially the same for all adhesive strips.

Figure 5:
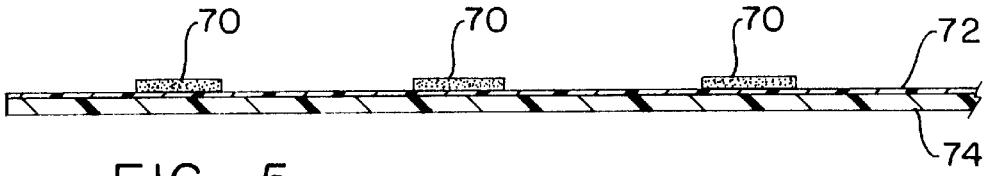
FIG. 5 is a transverse sectional view through the substrate and adhesive strip pattern.
Figure 6:
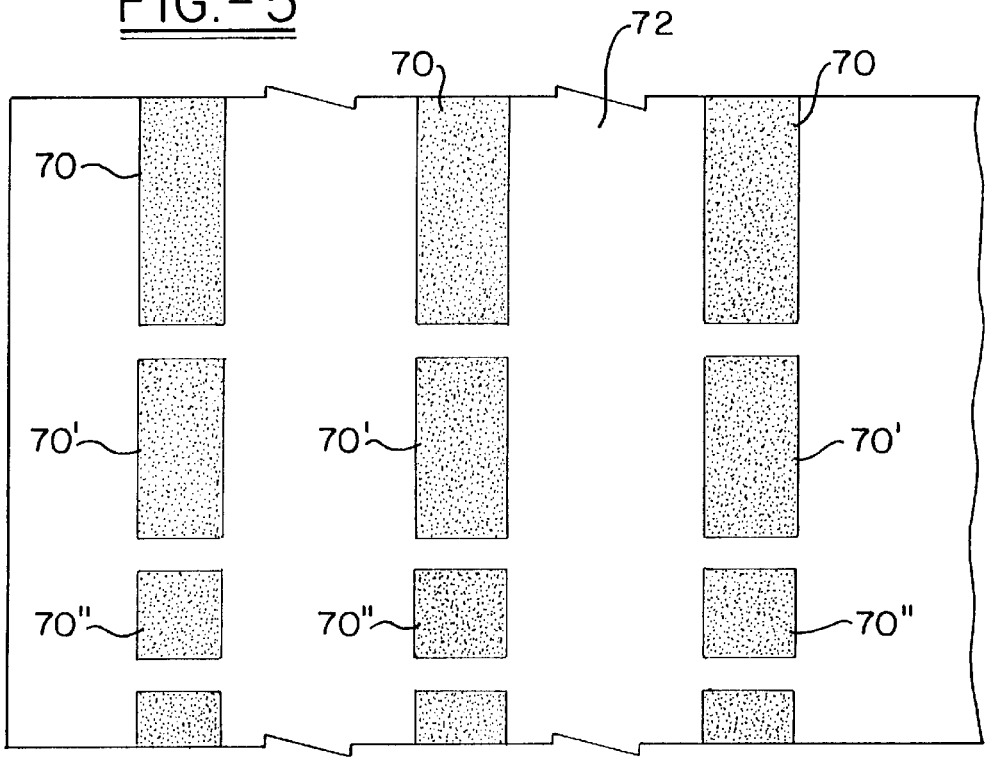
FIG. 6 is a plan view illustrating various adhesive strip patterns which may be applied to a substrate material.

As seen in FIGS. 5–6, the product, prior to slitting, is a multi-strip 70 adhesive product which is coated onto a silicone-coated 72 release liner 74. The thickness of the applied adhesive strips is from 10 to 100 mils, preferably 20–80 mils, more preferably, 25–35 mils. The product is a free (no carrier) film made to the desired width, typically greater than ⅜" inch, of high cohesive strength with good temperature resistance (greater than 180° F.) with low bubble content (appears clear), which is wound onto rolls containing from 100 to 800 feet in length of adhesive strips. The bonding capacity of these films are as high as 20 psi load bearing capacity, with competing adhesive foams being essentially half of that value. Through the operation of the timing sequence employed, it is possible for the strips to be discontinuous and of varying lengths, as shown for example by reference numerals 70, 70', and 70".

Prior art high performance mounting and bonding products that also required gap filling properties, relied on thick elastomeric foam carriers and solvent acrylic adhesive systems. These products were prone to end-use failure due to the inherent weakness of the elastomeric foam carrier. High mass pressure sensitive adhesive coatings were stronger than elastomeric foam carriers, but traditional process technologies limited the practical coating thickness to less than 20 mils. This invention overcomes the previous process limitations and provides for the economic production of high mass/high bond strength pressure sensitive adhesive films.

This invention has been described in detail with reference to specific embodiments thereof, including the respective best modes for carrying out each embodiment. It shall be understood that these illustrations are by way of example and not by way of limitation.

What is claimed is:

1. A process for pattern coating a plurality of strips of adhesive onto a release web comprising the steps of:

feeding an adhesive into a feed manifold in a die assembly, the die assembly comprising:

a die body having at least two exit ports in a front face of the die body; and at least two die cavity forming means, each of which receive adhesive exiting from at least one die body exit port, each die cavity forming means having at least one opening through which the adhesive can exit the die cavity forming means;

passing a silicone-coated web under the openings of the die cavity forming means in the die assembly and depositing at least two non-contacting adhesive strips thereon;

drying or curing the adhesive wherein the process of curing is selected from the group consisting of electron beam curing, ultraviolet curing and heat curing: and winding the adhesive coated web.

2. The process of claim 1 wherein the step of passing occurs over a roll which is chilled thereby minimizing the foaming of the adhesive.

3. The process of claim 1 which further comprises the step of passing the silicone-coated web with at least two non-contacting adhesive strips thereon through an accumulator.

4. The process of claim 1 wherein the die cavity forming means comprises:

a die shim having a longitudinal element extending along a length of the die body and at least three downwardly extending fingers;

a die shim attachment; and a die shim attachment fastening means which secures the die shim and die shim attachment to the die body, and wherein the die shim attachment and die body form two walls of the die cavity forming means and the downwardly extending fingers form side walls.

5. The process of claim 4 wherein the at least three downwardly extending fingers are essentially parallel.

6. The process of claim 4 wherein the at least three downwardly extending fingers form a cavity having a width as measured between the sidewalls which is narrower at the bottom opening of the cavity than at the top of the cavity.

7. The process of claim 4 wherein a thickness of the die shim is from about 1 to about 30 mils inclusive and a thickness of the adhesive strips is from about 10 to about 300 mils inclusive.

8. The process of claim 7 wherein a thickness of the die shim is from about 3 to about 15 mils inclusive and a thickness of the adhesive strips is from about 15 to about 200 mils inclusive.

9. The process of claim 8 wherein a thickness of the die shim is from about 4 to about 8 mils inclusive and a thickness of the adhesive strips is from about 25 to about 100 mils inclusive.

10. The process of claim 1 wherein the die cavity forming means comprises: a chamber which has at least one non-parallel side.

11. The process of claim 1 wherein the die cavity forming means is a die chamber having a length as measured between the front and rear walls which is wider at a top of the chamber than at a bottom opening of the chamber.

12. The process of claim 11 wherein the die cavity forming means further comprises a die chamber having a width as measured between the sidewalls which is narrower at the bottom opening of the chamber than at the top of the chamber.

13. The process of claim 1 wherein a thickness of the adhesive strips is from about 10 to about 300 mils inclusive.

14. The process of claim 13 wherein a thickness of the adhesive strips is from about 15 to about 200 mils inclusive.

15. The process of claim 14 wherein a thickness of the adhesive strips is from about 25 to about 100 mils inclusive.

16. A process for pattern coating a plurality of strips of adhesive onto a release web comprising the steps of.

feeding an adhesive into a die assembly;

moving the adhesive in the die assembly into at least one die chamber having at least two discrete and separated openings disposed therein for egress of the adhesive through the at least two openings;

passing a silicone-coated web under the at least two openings in the at least one die chamber in the die assembly;

depositing at least two non-contacting adhesive strips thereon by contact of the adhesive with the web as the adhesive exits from the discrete openings;

drying or curing the adhesive wherein the process of curing is selected from the group consisting of electron beam curing ultraviolet curing; and heat curing, and winding the adhesive coated web.

17. The process of claim 16 wherein the step of passing occurs over a roller which is chilled so as to minimize adhesive foaming.

18. The process of claim 16 wherein the die cavity forming means comprises:

a die shim having a longitude element extending along a length of the body and at least three downwardly extending fingers;

a die shim attachment; and a die shim attachment fastening means which secures the die shim attachment to the die body, and wherein the die shim attachment and die body form two walls of the die cavity forming means and the downwardly extending fingers form side walls.

19. The process of claim 18 wherein the at least three downwardly extending fingers are essentially parallel.

20. The process of claim 18 wherein the at least three downwardly extending fingers form a cavity having a width as measured between the sidewalls which is narrower at the bottom opening of the cavity than at the top of the cavity.

21. The process of claim 16 wherein the die cavity forming means comprises: a chamber which has at least one non-parallel side.

22. The process of claim 16 wherein the die cavity forming means is a die chamber having a length as measured between the front and rear walls which is wider at a top of the chamber than at a bottom opening of the chamber.

23. The process of claim 22 wherein the die cavity forming means further comprises a die chamber having a width as measured between the sidewalls which is narrower at the bottom opening of the chamber than at the top of the chamber.

24. The process of claim 16 wherein a thickness of the adhesive strips is from about 10 to about 300 mils inclusive.

25. The process of claim 24 wherein a thickness of the adhesive strips is from about 15 to about 200 mils inclusive.

26. The process of claim 25 wherein a thickness of the adhesive strips is from about 25 to about 100 mils inclusive.

27. The process of claim 26 wherein a thickness of the die shim is from about 1 to about 30 mils inclusive and a thickness of the adhesive strips is from about 10 to about 300 mils inclusive.

28. The process of claim 27 wherein a thickness of the die shim is from about 3 to about 15 mils inclusive and a thickness of the adhesive strips is from about 15 to about 200 mils inclusive.

29. The process of claim 28 wherein a thickness of the die shim is from about 4 to about 8 mils inclusive and a thickness of the adhesive strips is from about 25 to about 100 mils inclusive.

30. A process for pattern coating a plurality of strips of adhesive onto a release web comprising the steps of:

feeding an adhesive into a die assembly;

moving the adhesive in the die assembly into at least two die chambers, each having at least one opening in each die chamber therein for egress of the adhesive through the opening;

passing a silicone-coated web under the at least one opening in the at least two die chambers in the die assembly;

depositing at least two non-contacting adhesive strips thereon by contact of the adhesive with the web as the adhesive exits from the discrete openings;

drying or curing the adhesive wherein the process of curing is selected from the group consisting of electron beam curing ultraviolet curing and heat curing: and winding the adhesive coated web.

31. The process of claim 30 wherein the step of passing occurs over a roller which is chilled so as to minimize adhesive foaming.

32. The process of claim 30 wherein the die cavity forming means comprises:

a die shim having a longitudinal element extending along a length of the die body and at least three downwardly extending fingers;

a die shim attachment; and a die shim attachment fastening means which secures the die shim and die shim attachment to the die body, and wherein the die shim attachment and die body form two walls of the die cavity forming means and the downwardly extending fingers form side walls.

33. The process of claim 32 wherein the at least three downwardly extending fingers are essentially parallel.

34. The process of claim 33 wherein the at least three downwardly extending fingers form a cavity having a width as measured between the sidewalls which is narrower at the bottom opening of the cavity than at the top of the cavity.

35. The process of claim 30 wherein the die cavity forming means comprises: a chamber which has at least one non-parallel side.

36. as measured between the front and rear walls which is wider at a top of the chamber than at a bottom opening of the chamber.

37. The process of claim 36 wherein the die cavity forming means further comprises a die chamber having a width as measured between the sidewalls which is narrower at the bottom opening of the chamber than at the top of the chamber.

38. The process of claim 30 wherein a thickness of the adhesive strips is from about 10 to about 300 mils inclusive.

39. The process of claim 38 wherein a thickness of the adhesive strips is from about 15 to about 200 mils inclusive.

40. The process of claim 39 wherein a thickness of the adhesive strips is from about 25 to about 100 mils inclusive.

41. The process of claim 36 wherein a thickness of the die shim is from about 1 to about 30 mils inclusive and a thickness of the adhesive strips is from about 10 to about 300 mils inclusive.

42. The process of claim 41 wherein a thickness of the die shim is from about 3 to about 15 mils inclusive and a thickness of the adhesive strips is from about 15 to about 200 mils inclusive.

43. The process of claim 42 wherein a thickness of the die shim is from about 4 to about 8 mils inclusive and a thickness of the adhesive strips is from about 25 to about 100 mils inclusive.

* * * * *